United States Patent [19]

Regnault et al.

[11] 4,155,618

[45] May 22, 1979

[54] BASE ASSEMBLY FOR AN ELECTRON TUBE

[75] Inventors: John H. Regnault; Robert E. Benway, both of Marion, Ind.

[73] Assignee: RCA Corporation, New York, N.Y.

[21] Appl. No.: 870,656

[22] Filed: Jan. 19, 1978

[51] Int. Cl.[2] ..... H01R 13/00

[52] U.S. Cl. ..... 339/145 R

[58] Field of Search ..... 339/144 R, 144 T, 145 T, 339/146, 111, 143 T, 193 R, 145 R, 145 D

[56] References Cited

U.S. PATENT DOCUMENTS 4,064,412 12/1977 Johnson ..... 339/144 T X

*Primary Examiner*—Joseph H. McGlynn
*Assistant Examiner*—John S. Brown
*Attorney, Agent, or Firm*—Eugene M. Whitacre; Glenn H. Bruestle; Dennis H. Irlbeck

[57] ABSTRACT

A body of electrically insulating material is provided with a plurality of apertures extending between two surfaces thereof to accommodate an equal number of electrically conductive pins extending from the tube. One of the surfaces of the body of the base is recessed at the location of one of the apertures. The recess communicates with at least one elongated cavity adjacent the associated aperture. The cavity extends at least partially between the two surfaces of the body. The assembly includes an electrically insulative elastic gasket disposed within the recess. A first portion of the gasket is preferably of tubular shape and has greater length than the depth of the recess. The longitudinal axis of the first portion is aligned with the longitudinal axis of the associated aperture. A second portion of the gasket generally matches the shape of the recess in the base body. A third portion of the gasket is seated in the body cavity for maintaining the position of the gasket relative to the body.

6 Claims, 11 Drawing Figures

BASE ASSEMBLY FOR AN ELECTRON TUBE

BACKGROUND OF THE INVENTION

The present invention relates to electron tubes and particularly to a tube-base assembly having improved high voltage stability between electrically conductive pins.

Electrical connection to internal components in an electron tube is usually made through conductive pins which extend through the glass envelope of the tube. In a cathode ray tube, these pins extend from the end of the tube neck and are protected by a tube base. Generally, tube bases are formed of hard plastic material which abuts the tube neck. The pins pass through apertures in the base whereby the base adds stiffness and strength to the pins as well as providing insulation between the pins.

In the past, bases have been glued to the tubes so that they would remain fixed regardless of the number of times the bases might be inserted into or removed from their associated sockets. However, it has been found that a cost reduction can be realized if the bases are force-fit onto the pins without use of an adhesive. Unfortunately, with use, a force-fit base may loosen and become somewhat spaced from the tube envelope. When some separation of the base does occur, there is a gap in the insulation between pins. Because of the gap, arcing between a high voltage conducting pin and a lower voltage conducting pin can develop. Such arcing is extremely undesirable.

SUMMARY OF THE INVENTION

An electron tube incorporating the present invention has an improved base assembly comprising a body of electrically insulating material with a plurality of apertures extending between two surfaces thereof to accomodate an equal number of electrically conductive pins extending from the tube. One of the surfaces of the body of the base is recessed at the location of one of the apertures. The recess communicates with at least one elongated cavity adjacent the associated aperture. The cavity extends at least partially between the two surfaces of the base body. The assembly includes an electrically insulative elastic gasket disposed within the recess. A first portion of the gasket is preferably of tubular shape and has greater length than the depth of the recess. The longitudinal axis of the first portion is aligned with the longitudinal axis of the associated aperture. A second portion of the gasket generally matches the shape of the recess in the base body. A third portion of the gasket is seated in the body cavity for maintaining the position of the gasket relative to the body.

DETAILED DESCRIPTION

Figure 1:
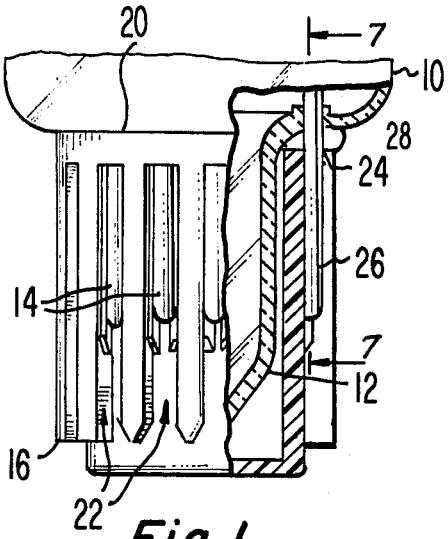
FIG. 1 is a side view, partly in axial section of an electron tube neck and a base assembly.

FIG. 1 shows the end of a neck 10 of a glass cathode ray tube. An exhaust tubulation 12 extends from an end of the neck 10 and is surrounded by twelve electrical conductor pins 14 which pass through the glass wall of the neck to provide electrical connection to the internal tube components. The exhaust tubulation 12 is enclosed by a tube base 16 which comprises a hollow-cylindrical body of molded insulating plastic. The base 16 has a plurality of apertures 18 extending from a surface 20 of the base that contacts the neck 10 to a series of longitudinally extending grooves 22 in an outer cylindrical surface of the base. Each pin 14 extends through an aperture 18 and rests in one of the grooves 22. The diameter of each aperture 18 is slightly smaller than the outer diameter of each pin 14 to ensure that the base 16 is held firmly once it is force-fit mounted to the neck. Because of the tight fit, generally no adhesive is necessary to maintain attachment of the base to the neck.

Figure 2:
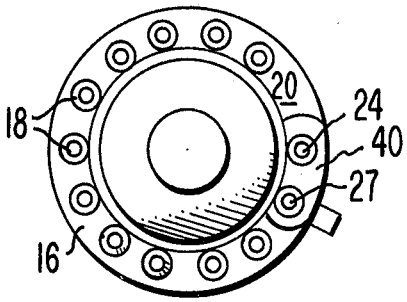
FIG. 2 is a plan view of the upper or inner end of the base of FIG. 1.

The top surface 20 of the base 16 is shown in greater detail in FIG. 2. Eleven of the pin receiving apertures 18 are evenly spaced apart and the twelfth pin receiving aperture 24 is spaced further from its adjacent apertures. This twelfth aperture 24 receives a focus pin 26 of the tube which carries the highest voltage of any pin, e.g., 13 Kv. Because of a relatively great voltage difference between the focus pin 26 and its adjacent pins, there is a definite likelihood for an electrical arc to form between these pins. An elongated cavity 27 is located adjacent the twelfth pin receiving aperture 24. The purpose of this cavity 27 will be described later. Generally, the structure of the base 16 is such that the pins are insulated by the base from each other. However, if the base 16 becomes loosened from the neck 10 such that a gap is formed therebetween, there is again the opportunity for an arc to form in such gap. Various contaminents also can enhance the possibility of such arcs. For example, dirt, moisture, oil from fingers, oxides on the glass, or even atmospheric conditions at the time of assembly can add to the likelihood of arcing.

Figure 3:
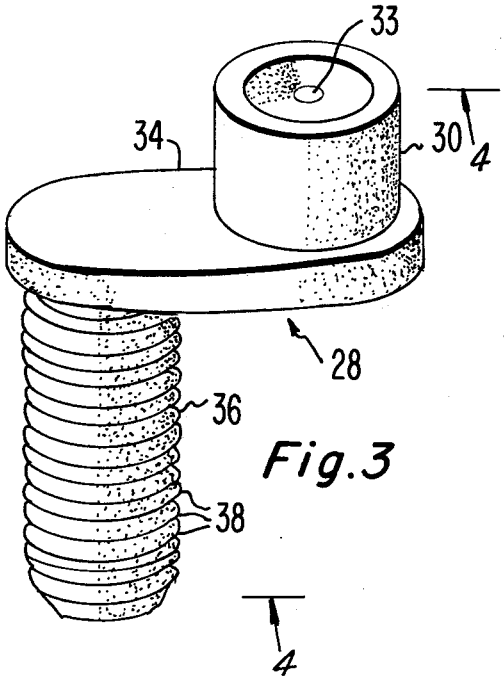
FIG. 3 is a perspective view of an elastic gasket.
Figure 4:
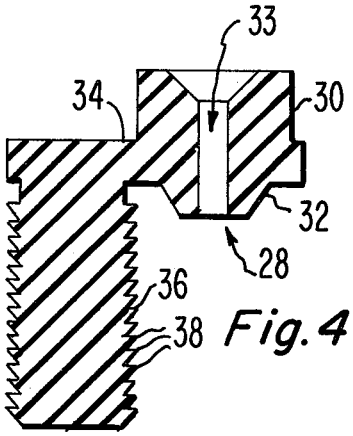
FIG. 4 is an axial section view of the gasket of FIG. 3.

The present base reduces the likelihood of arcing by providing a deformable elastic gasket 28 around the focus pin 26 between the neck 10 and the base 16 as shown in FIG. 1. The gasket 28 in its undeformed configuration is shown in FIGS. 3 and 4. The gasket 28 should be made of an elastic material having good insulating properties such as silicone rubber. The gasket 28 has three integral portions. The first portion 30 is of cylindrical-shape with a conical projection 32 at one end conforming to the shape of a tappered portion of the twelfth aperture 24 of the base 16. A tubular aperture 33 for receiving the pin 26, extends through the center of the first portion 30. A second portion 34 of the gasket 28 comprises a flat intermediate part extending to one side of the first portion 30. A third portion 36, substantially cylindrical in shape, extends from the second portion 34. The third portion 36 is located on the opposite side of the second portion 34 from the bulk of the first portion 30. The central longitudinal axis of the third portion 36 is substantially parallel with the central longitudinal axis of the first portion 30 although the two axes are offset from each other the distance between the aperture 24 and the cavity 27 in the base 16. The external surface of the third portion 36 includes a plurality of annular ridges 38 for maintaining a frictional engagement with the cavity 27.

In order to accomodate the gasket 28, a recess 40 is provided in the upper surface 20 of the base around the focus pin aperture 24 and the cavity 27 as shown in FIG. 2. This recess 40 is larger in diameter than the undeformed first portion 30 of the gasket 28 so that when the first portion 30 is deformed, it will flatten and spread radially into the volume of the recess 40.

Figure 5:
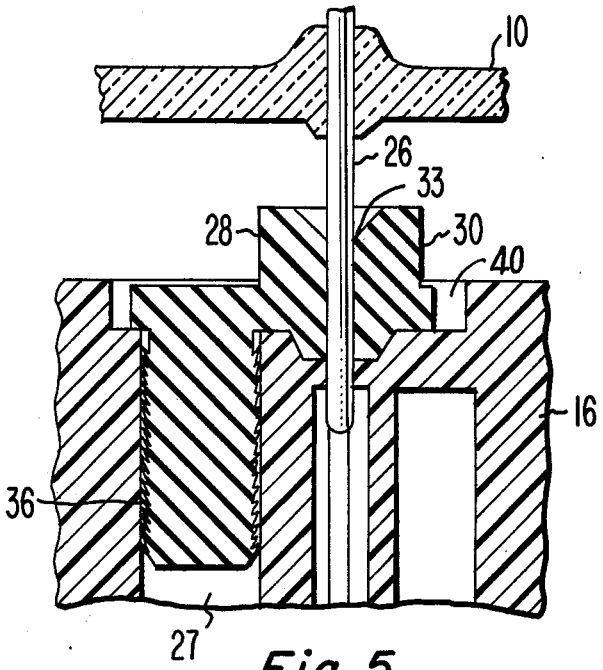
FIGS. 5, 6, and 7 are sequential section views of a tube neck and base assembly during fabrication.

In FIG. 5, the third portion 36 of the gasket 28 has been inserted into the cavity 27 and the base 16 is partially seated on the pins with the focus pin 26 extending through the gasket aperture 33. The gasket third portion 36 provides means for holding the gasket 28 in position relative to the base 16 during assembly. Therefore, the gasket 28 can be attached to the base 16 without use of an adhesive thereby eliminating at least one manufacturing step.

Figure 6:
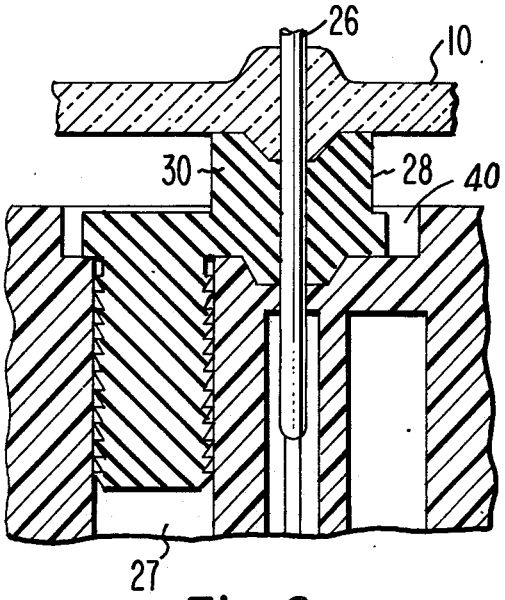
Figure 7:
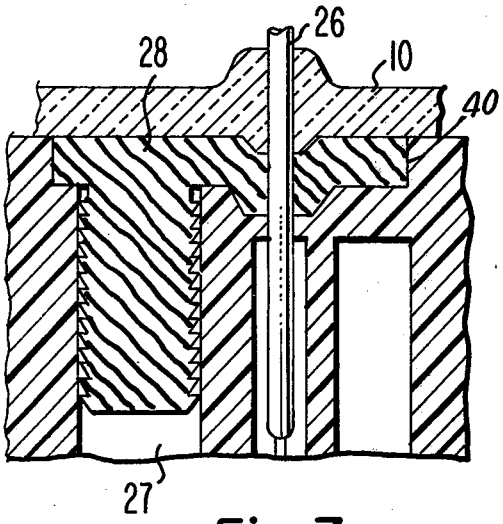

In FIG. 6, the first portion 30 of the gasket 28 is in contact with both the neck 10 and the base 16 but has not yet been deformed. Completed attachement of the base 16 to the neck is shown in FIG. 7. It should be noted that from the time the gasket first portion 30 contacts both the neck 10 and the base 16 (FIG. 6) until the base 16 is completely installed, the focus pin 26 is completely protected by the gasket 28. After installation of the base 16, should the base 16 pull away from the neck 10, the gasket 28 will tend to return to its original shape thereby continuing to insulate and protect the focus pin 26.

Figure 8:
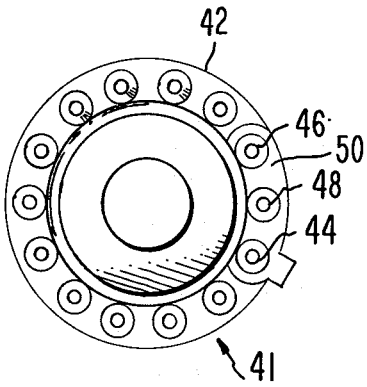
FIG. 8 is a plan view of the upper or inner end of another base.

Another tube base 42 is shown in FIG. 8. This base 42 is similar to the base 16 of FIGS. 1 and 2 except that two elongated cavities 44 and 46, instead of one, are provided on opposite sides of a focus pin aperture 48. The base 42 also has a larger recess 50 extending slightly past each cavity.

Figure 9:
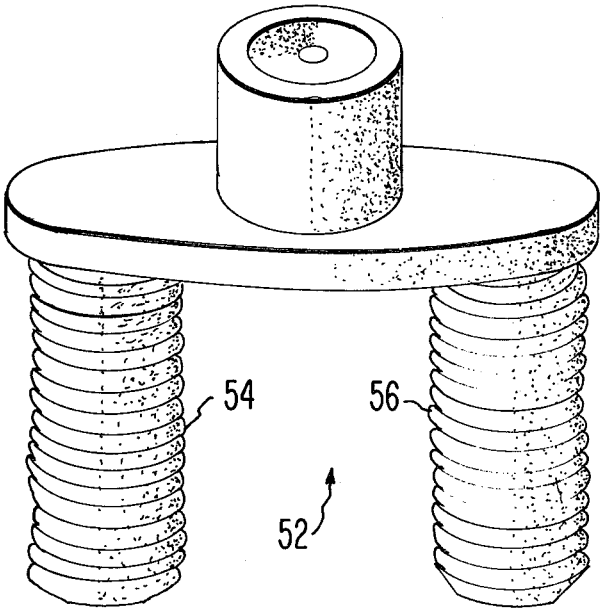
FIG. 9 is a perspective view of another elastic gasket.

A gasket 52 associated with the base 42 is shown in FIG. 9. This gasket 52 is similar to the gasket 28 of FIG. 3 except that it is a balanced design having two extensions 54 and 56, rather than one, for insertion into the two cavities 44 and 46 of the base 42. Such design provides better assurance that the gasket 52 will remain secured to the base 42 and centered with respect to the focus pin aperture 48.

Figure 10:
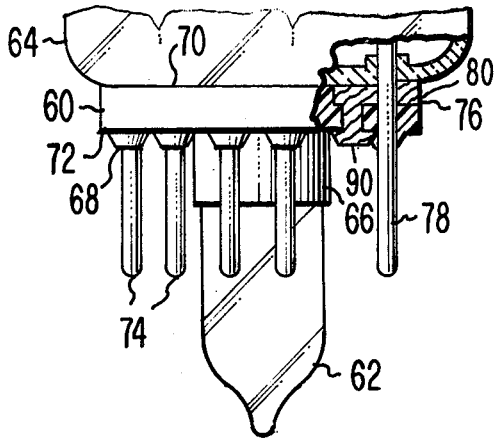
FIG. 10 is a side view, partially in axial section of an electron tube neck and another base assembly.
Figure 11:
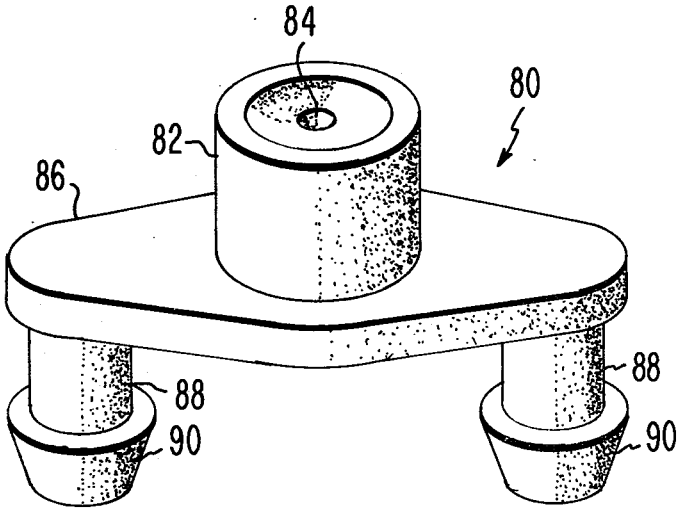
FIG. 11 is a perspective view of another elastic gasket.

In both of the foregoing base embodiments, the tube pins rest in grooves in the base. In another type of base 60, shown in FIG. 10, the base 60 comprises an annular-disk shaped body of molded insulating plastic surrounding an exhaust tubulation 62 extending from the end of a tube neck 64. The base 60 also includes a cylindrical portion 66 that extends along the exhaust tubulation 62 to guide and steady the position of the base 60. A plurality of apertures 68 extend from a surface 70 of the base that contacts the neck 64 to the opposite surface 72 of the base. A plurality of electrical conductor pins 74, which pass through the glass wall of the neck 64, extend through the apertures 68 and are exposed at the opposite side of the base 60. As in the previous embodiments, the base surface 70 includes a recess 76 at the location of a high voltage focus pin 78. The recess 76 communicates with two elongated cavities similar to those shown in FIG. 8. A deformable elastic gasket 80, shown in its undeformed configuration in FIG. 11, is seated in the recess 76. The gasket 80 comprises a first portion 82 which is cylindrical in shape and includes an aperture 84 for accomodating the focus pin 78. A second portion 86 of the gasket 80 comprises a flat intermediate part extending on opposite sides of the first portion 82. Two third portions 88 extend from the ends of the second portion 86 on the side opposite the first portion 82. Each of these third portions 88 is cylindrical in shape and has a wider flange 90 at its distal end. The third portions 88 of the gasket 80 are inserted through the two cavities in the base 60 located on opposite sides of the focus pin aperture. The third portions 88 are of such length that they extend entirely through the base 60 and thus permitting the flanges 90 to engage the opposite surface 72 of the base 60 thereby securing the position of the gasket 80.

We claim:

1. A base assembly for an electron tube comprising, a body of electrically insulating material having a plurality of apertures therein extending from a first surface thereof to a second surface thereof, the second surface of said body having a recess therein at the location of one of said apertures and extending laterally away from said one aperture, said recess communicating with at least one elongated cavity in said body located adjacent the one aperture, and a deformable electrically insulative elastic gasket disposed within the recess of said body, said gasket having a first portion having an aperture therein aligned with the one aperture of said body associated with the recess, a second portion of said gasket generally matching the shape of and seated in the recess in said body, and a third portion of said gasket being seated in the elongated cavity in said body for maintaining the position of said gasket relative to said body.

2. The base assembly as defined in claim 1 including said first portion in its undeformed state being of tubular shape and having greater length than the depth of the recess in said body, the longitudinal axis of the first portion being aligned with the longitudinal axis of the one aperture.

3. The base assembly as defined in claim 1, wherein said elastic gasket is made of silicone rubber.

4. The base assembly as defined in claim 1, wherein the third portion of the gasket includes a plurality of ridges which create a force within the cavity of said body.

5. The base assembly as defined in claim 1, wherein the cavity extends through said body from said second surface to said first surface and the third portion of said gasket extends through the cavity and has a flange at the distal end thereof larger than the diameter of the cavity, said flange engaging said first surface to hold said gasket in position relative to said body.

6. The base assembly as defined in claim 1, including two elongated cavities located on opposite sides of the one aperture wherein said recess extends to both sides of the one aperture and communicates with both elongated cavities in said body and wherein said gasket includes two third portions each seated in a different cavity.

* * * * *

UNITED STATES PATENT AND TRADEMARK OFFICE
CERTIFICATE OF CORRECTION

PATENT NO. : 4,155,618

DATED : May 22, 1979

INVENTOR(S) : John Henry Regnault et al.

It is certified that error appears in the above-identified patent and that said Letters Patent is hereby corrected as shown below:

| | | |
|---|---|---|
| Column 1, | line 63 | after "3" should be --generally taken along line 4-4-- |
| | line 65 | after "fabrication" should be --generally taken along line 7-7 of FIGURE 1--. |

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*